United States Patent [19]

Miller

[11] Patent Number: 5,012,718

[45] Date of Patent: May 7, 1991

[54] IMPINGEMENT PRESSURE REGULATOR

[75] Inventor: Lee D. Miller, Bristol, United Kingdom

[73] Assignee: British Aerospace Public Limited Company, London, England

[21] Appl. No.: 412,807

[22] Filed: Sep. 27, 1989

[30] Foreign Application Priority Data

Oct. 27, 1988 [GB] United Kingdom ..... 8825195

[51] Int. Cl.[5] ..... F41F 3/04

[52] U.S. Cl. ..... 89/1.816; 89/1.8

[58] Field of Search ..... 89/1.812, 1.809, 1.810, 89/1.816, 1.818, 1.703, 1.704, 1.705, 1.706, 1.8

[56] References Cited

U.S. PATENT DOCUMENTS

| | | | |
|---|---|---|---|
| 3,298.278 | 1/1967 | Barakauskas | 89/1.810 |
| 4,185,538 | 1/1980 | Barakauskas | 89/1.810 |
| 4,186,647 | 2/1980 | Piesik | 89/1.816 |
| 4,203,347 | 5/1980 | Pinson et al. | 89/1.816 |
| 4,426,909 | 1/1984 | Carter | 89/1.816 |
| 4,436,016 | 3/1984 | Olmstead et al. | 89/1.809 |
| 4,683,798 | 8/1987 | Piesik | 89/1.812 |
| 4,686,884 | 8/1987 | Piesik | 89/1.816 |
| 4,796,510 | 1/1989 | Piesik | 89/1.816 |

*Primary Examiner*—David H. Brown

*Attorney, Agent, or Firm*—Cushman, Darby & Cushman

[57] ABSTRACT

Apparatus for launching a projectile which has a nozzle for emitting gas during launch, said apparatus comprising means for supporting a projectile and a chamber having an orifice positioned to receive some or all of a jet from the projectile nozzle wherein the chamber is configured so that pressure is developed therein to provide an additional boost to the projectile during launch.

8 Claims, 3 Drawing Sheets

IMPINGEMENT PRESSURE REGULATOR

This invention relates to a pressure regulator, in particular to an impingement pressure regulator which is used to control the pressure in a vessel, such as for example the launch tube of a projectile.

When a projectile is launched from say a canister, the exhaust gases of the projectile are generally allowed to escape through the top of the canister. This wastes quite a lot of energy which if utilised could increase the thrust of the launching missile.

It is well known to regulate pressure within a vessel, but often control of the pressure is difficult to adjust due to a high back pressure which can prove to be a limit on the regulator.

One object of this invention is to provide a pressure regulator which can tolerate far greater orifice back pressures than known regulators and in which control pressure may be easily adjusted so that the exhaust gases of say a launching projectile can be used to generate additional thrust.

According to a first aspect of the present invention there is provided apparatus for launching a projectile which has a nozzle for emitting gas during launch, said apparatus comprising means for supporting a projectile and a chamber having an orifice positioned to receive some or all of a jet from the projectile nozzle wherein the chamber is configured so that pressure is developed therein to provide an additional boost to the projectile during launch.

Preferably, the orifice is positioned so as, in use, to be aligned with the projectile nozzle.

According to a second aspect of the present invention there is provided a pressure regulator for controlling the pressure in a vessel comprising:

a nozzle;

means for supplying a control jet of fluid to said vessel from said nozzle; and, an orifice positioned to receive some or all of said jet, wherein, in use, said control jet is supplied continuously.

Preferably, said pressure regulator is configured so that the diameter of said control jet changes according to the pressure differential between the control jet and the vessel pressure until the diameter of the control jet equals the effective diameter of the orifice at a required control pressure.

Advantageously, said nozzle is a sonic nozzle. Alternatively, said nozzle may be a supersonic nozzle.

Reference will now be made, by way of example, to the accompanying drawings in which.

Figure 1:
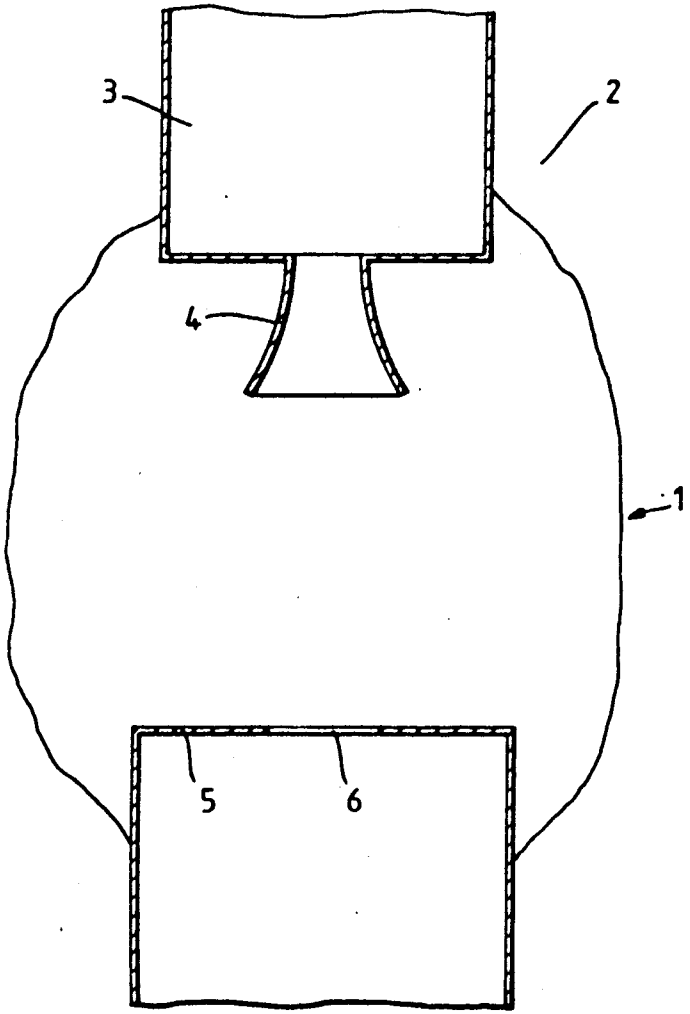
FIG. 1 is a simplified diagram of an impingement pressure regulator for controlling pressure in a vessel.

Referring to FIG. 1, the internal pressure of a vessel shown generally at 1 is controlled by an impingement pressure regulator 2, in order to achieve and maintain a required control pressure. The regulator 2 comprises a gas supply 3, a nozzle 4, and an orifice plate 5 which defines a circular orifice 6. The nozzle 4 is chosen to produce a jet which reduces in diameter as the internal pressure of the vessel increases and is, for example, a sonic nozzle which produces an under-expanded jet. In general, the centre line of the jet produced by the nozzle is aligned with the centre of the orifice 6.

Figure 2:
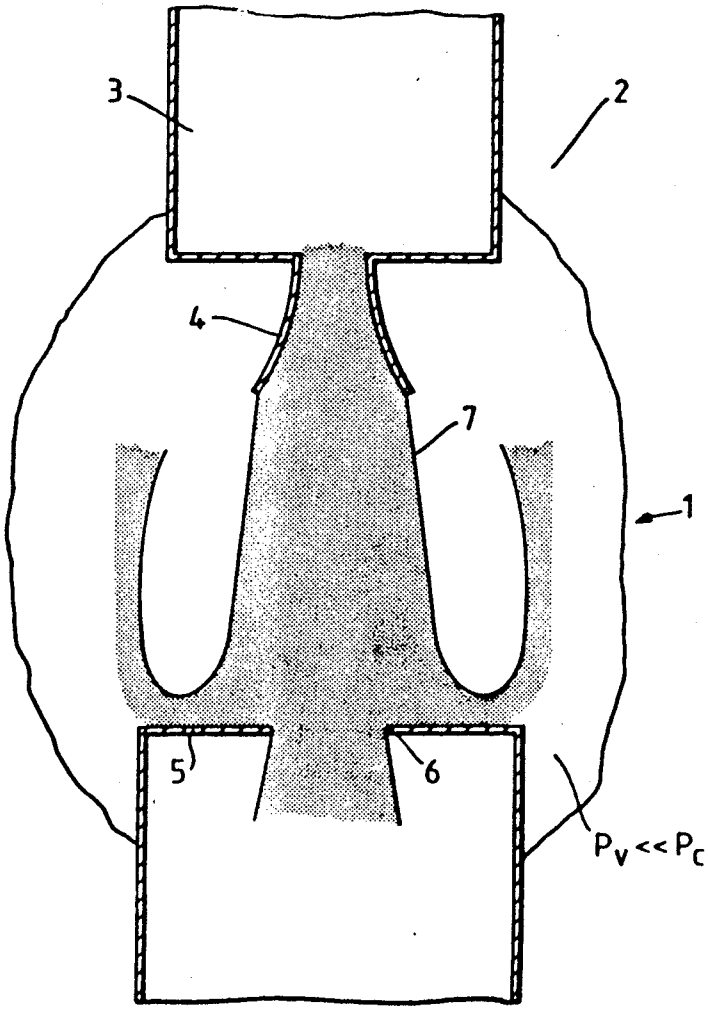
FIG. 2 is a simplified diagram of the regulator of FIG. 1 in which the vessel pressure is very much less than the required control pressure.
Figure 4:
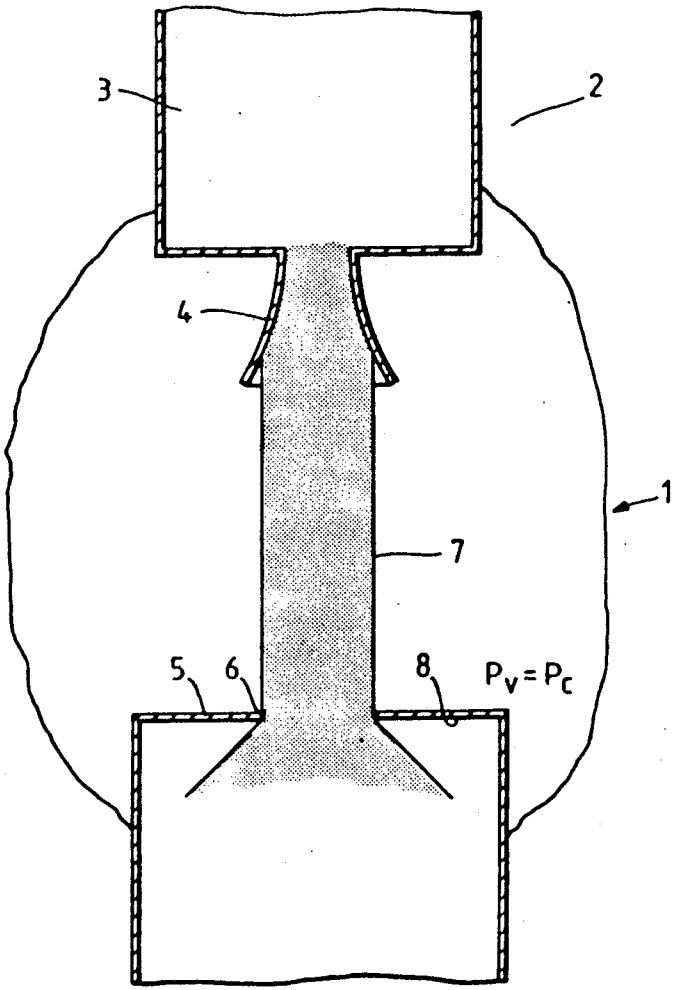
FIG. 4 is a simplified diagram of the regulator of FIG. 1 in which the vessel pressure equals the control pressure; and, FIG. 5 is a diagram of a missile launch tube including one of the impingement pressure regulators of FIGS. 1 -4.
Figure 3:
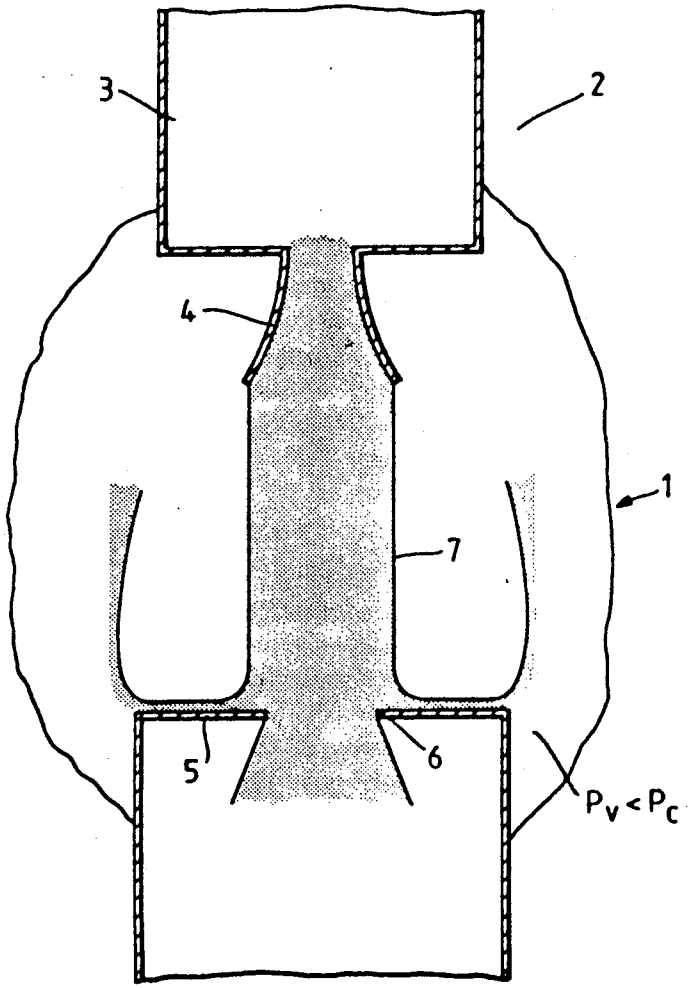
FIG. 3 is a simplified diagram of the regulator of FIG. 1 as the vessel pressure increases.

Referring to FIG. 2, a jet 7 is produced and introduced into the vessel 1, in which the vessel pressure Pv is very much less than the required control pressure Pc. The jet 7 is a supersonic jet, that is to say the gas stagnation pressure of the jet Poj is at least two times the required control pressure Pc, i.e. $P_{oj} > Pc$. Since $P_{oj} >> Pv$, the jet expands within the vessel 1 and impinges on the orifice plate 5, i.e. the effective jet diameter is greater than the effective orifice diameter. This results in an increase of gas within the vessel, thereby causing an increase in Pv. As Pv increases the jet diameter decreases as shown in FIG. 3 and a smaller proportion of the jet 7 impinges on the orifice plate 5. The vessel pressure Pv continues to rise until Pv=Pc at which point the effective diameter of the jet and the diameter of the orifice are equal, and there is no net mass flow into the vessel 1 as shown in FIG. 4. That is to say some of the jet still falls on the plate but an equivalent amount is sucked into the jet from the surroundings and transferred out of the chamber. When the pressure in the vessel reaches Pc, substantially the entire jet of fluid is exhausted through the orifice as shown in FIG. 4. If Pv is deliberately raised above Pc, jet entrainment will ensure that Pv is reduced to Pc.

Pc may be adjusted by altering, for example, the following regulator parameters:

1. the ratio of the orifice and the effective nozzle diameter, (the greater the ratio the smaller Pc becomes);

2. the spacing between the orifice plate and the nozzle (the greater the spacing the greater Pc becomes); and, 3. The greater the gas pressure Pj of the jet, the greater Pc becomes.

The orifice back pressure $P_B$ acts on the external surface 8 of the orifice plate. In this type of pressure regulator $P_B$ can be at least as large as Pc without influencing the pressure regulation process within the vessel and for supersonic jets $P_B$ can be very much greater than Pc.

The regulator response is the rate of pressure rise within the vessel which is determined by the amount of gas from jet 7 impinging on the orifice plate which in turn is governed by the jet mass flow rate.

Figure 5:
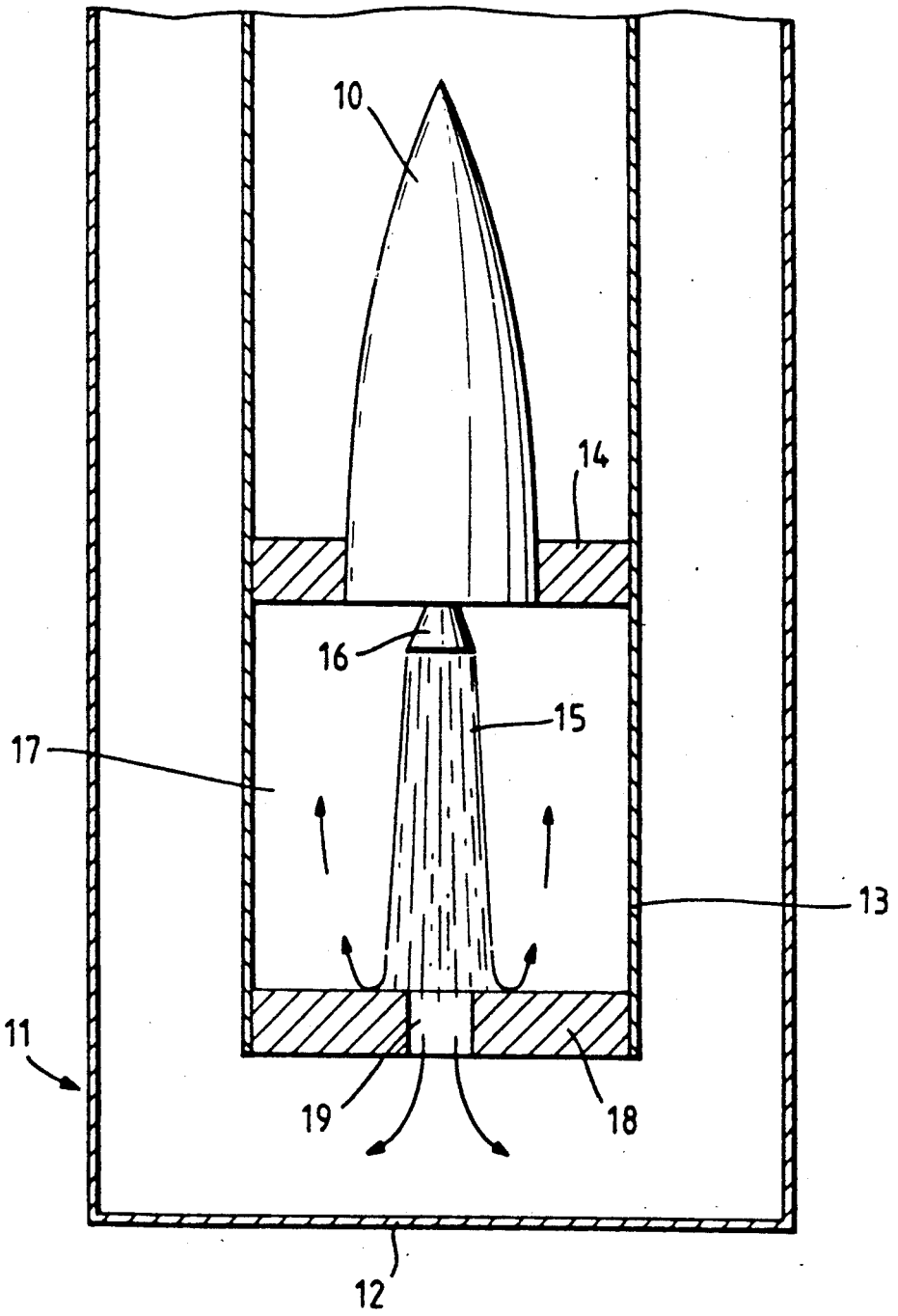

FIG. 5 shows a missile 10 within a launch tube shown generally at 11. The launch tube comprises an outer canister 12 and an inner canister 13 in which the missile is located. The missile is surrounded by a sabot 14 which makes a seal between the missile 10 and canister 13. Once the propellant within the missile is ignited, prior to launch, the external gases are expelled in a jet 15 from nozzle 16 into area 17. The jet 15 impinges on a plate 18 at the base of canister 13. The plate 18 has an orifice 19 located therein through which some of the exhaust gases may be expelled. The remainder of the jet impinges on the plate and is reflected back into the chamber. This gradually increases the pressure within the area 17, in the same way as previously described. There is no net mass flow within area 17 when the required control pressure is reached. If the missile is launched when the control pressure is attained an additional thrust (proportional to the control pressure) is imparted to the missile.

As described earlier the control pressure may be increased or desreased to whatever level is required.

It should be noted that due to the method of operation of the regulator, either in situ in a launch tube or in situ in another sort of vessel, the gas supply must be supplied at all times during use. In the former case this is provided by the exhaust gases of the missile. For long period operation the need for a continuous supply would require either a large gas reservoir or a compressor to recycle vented gas.

It should also be noted that this regulator may be used in any suitable type of vessel other than say a missile launch tube.

It will be appreciated that the orifice within the plate may be of any shape or size. By way of example only it may be circular, rectilinear or comprise say a network of holes differing sizes and/or position within the orifice plate.

I claim:

1. An apparatus for launching a projectile which has a projectile body and a nozzle at one end of said projectile body for emitting gas during launch, said apparatus comprising:

support means for supporting said projectile body at least during launch;

means for generating additional thrust during launch comprising:

means defining a chamber in surrounding relation to said one end of said projectile body and in communication with said projectile nozzle for receiving at least some of said gas emitted from said nozzle during launch, and means defining an orifice in a wall of said chamber for receiving and exhausting at least some of a jet emitted from said projectile nozzle during launch, said orifice being sized and disposed with respect to said projectile nozzle so that a predetermined pressure is generated within said chamber during launch to thereby provide an additional boost to said one end of said projectile body during launch, and canister means around and spaced from said chamber means and including a closed end spaced from said orifice.

2. An apparatus as in claim 1, wherein said orifice is defined in said wall of said chamber so as to be coaxial with a central axis of said projectile nozzle.

3. An apparatus according to claim 1 or claim 2, wherein said wall defining said chamber includes a base plate, said orifice being defined through said base plate.

4. An apparatus according to claim 1, wherein said support means comprises a launch canister, said launch canister having a base so as to define said chamber in surrounding relation to said one end of said projectile body, said orifice being defined through said base launch canister.

5. A pressure regulator for controlling the pressure in a vessel comprising:

a vessel;

a nozzle for supplying a jet of fluid;

means for operatively coupling said nozzle to said vessel so that said jet of fluid is supplied from said nozzle to an interior of said vessel;

means defining an orifice through a wall of said vessel said orifice receiving and exhausting at least some of said jet of fluid; and canister means around said vessel in spaced relation thereto and including a closed end spaced from said wall;

said orifice being sized and disposed relative to said nozzle so that when a predetermined pressure Pc is generated within said vessel by said jet of fluid from said nozzle, substantially said entire jet of fluid is exhausted through said orifice into said canister means.

6. A pressure regulator according to claim 5, wherein when a pressure Pv of said vessel is substantially less than said pressure Pc, said jet of fluid has a first diameter and when said pressure Pv equals said pressure Pc, said jet of fluid has a second diameter substantially corresponding to a diameter of said orifice, said diameter of said jet of fluid varying between said first diameter and second diameter in accordance with said vessel pressure.

7. A pressure regulator according to claim 5, wherein said nozzle is a sonic nozzle.

8. A pressure regulator according to claim 5, wherein said nozzle is a supersonic nozzle.

* * * * *